US008601844B2

(12) United States Patent
Yamane

(10) Patent No.: US 8,601,844 B2
(45) Date of Patent: Dec. 10, 2013

(54) MULTI-ROLL MANDREL MILL AND METHOD OF PRODUCING SEAMLESS TUBES

(75) Inventor: Akihito Yamane, Kyoto (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/425,749

(22) Filed: Mar. 21, 2012

(65) Prior Publication Data

US 2012/0174642 A1 Jul. 12, 2012

Related U.S. Application Data

(63) Continuation of application No. PCT/JP2010/005367, filed on Sep. 1, 2010.

(30) Foreign Application Priority Data

Sep. 29, 2009 (JP) ..... 2009-224935

(51) Int. Cl.
*B21B 17/08* (2006.01)
*B21B 19/08* (2006.01)

(52) U.S. Cl.
USPC ..... 72/96; 72/208; 72/224; 72/252.5

(58) Field of Classification Search
USPC ..... 72/96, 208, 209, 97, 224, 235, 252.5, 72/237, 48, 51, 52; 492/1
See application file for complete search history.

(56) References Cited

U.S. PATENT DOCUMENTS

| | | | | |
|---|---|---|---|---|
| 3,584,490 | A * | 6/1971 | Bindernagel | 72/224 |
| 4,269,055 | A * | 5/1981 | Sivachenko et al. | 492/1 |
| 4,763,394 | A * | 8/1988 | Decato et al. | 29/252 |
| 5,953,948 | A * | 9/1999 | Isozaki | 72/224 |
| 6,276,182 | B1 * | 8/2001 | Cernuschi et al. | 72/235 |

FOREIGN PATENT DOCUMENTS

| | | |
|---|---|---|
| EP | 1611969 | 1/2006 |
| JP | 2002-035810 | 2/2002 |
| JP | 2006-272340 | 10/2006 |
| JP | 2008-296250 | 12/2008 |
| WO | 2008/123121 | 10/2008 |

* cited by examiner

*Primary Examiner* — Dana Ross
*Assistant Examiner* — Pradeep C Battula
(74) *Attorney, Agent, or Firm* — Clark & Brody

(57) ABSTRACT

A multi-roll mandrel mill comprises a plurality of grooved roll bodies as a roll pass for elongation rolling of a shell and a plurality of roll stands, each having roll shafts and roll chock portions for driving the grooved roll bodies for driving the grooved roll bodies, wherein bearings are internally contained in each grooved roll body. Optimizing the design of roll chock portions for every setup is achieved by a tube-making setup of the mandrel mill, wherein at least one of either or both of the roll shafts and the roll chock portions is replaced with a part(s) having a different shape(s) in addition to changing of the grooved roll bodies. The optimization of the design is effective in preventing underfill and overfill.

4 Claims, 4 Drawing Sheets

MULTI-ROLL MANDREL MILL AND METHOD OF PRODUCING SEAMLESS TUBES

TECHNICAL FIELD

The present invention relates to a multi-roll mandrel mill and a method of producing seamless tubes using such a multi-roll mandrel mill. More specifically, the present invention relates to a multi-roll mandrel mill which can effectively prevent underfill and overfill in a mandrel mill and a method of producing seamless tubes using such a multi-roll mandrel mill.

Unless otherwise described, terms in this specification are defined as follows.

"Multi-roll mandrel mill": A mandrel mill which is provided with a plurality of roll stands in each of which 3 or 4 grooved rolls are arranged as a roll pass.

"Roll diameter ratio": When the roll diameter in the groove bottom of a grooved roll arranged in a roll stand (groove-bottom roll diameter) is denoted by Dr and the section diameter of a shell subjected to elongation-rolling by use of the grooved roll is denoted by Dp, the roll diameter ratio is expressed by Dr/Dp. The section diameter of a shell is defined as the section diameter of the shell whose radius is represented by the distance from a portion corresponding to the roll groove bottom to the axial centerline of the tube.

"Underfill": A phenomenon in which during the rolling of a shell, the outer peripheral length of the shell becomes significantly short to thereby cause the inner surface of the shell to stick to a mandrel bar.

"Overfill": A phenomenon in which during the rolling of a shell, the outer peripheral length of the shell becomes excessively long to thereby cause the shell metal to protrude from the flanged portion of a grooved roll.

BACKGROUND ART

In the production of a seamless tube on a mandrel mill, first, a heated solid billet is pierced by a piercer to make a hollow shell. Subsequently, after insertion of a mandrel bar into this hollow shell, the shell is usually subjected to elongation-rolling on a mandrel mill consisting of five to eight roll stands. As a result of this elongation rolling, the shell wall thickness is adjusted to a prescribed wall thickness and the shell is subjected to circumference working where the outside diameter thereof is decreased to cause the circumference length thereof to be reduced. After the completion of elongation rolling, the mandrel bar is withdrawn/stripped. Thereafter, the elongation-rolled shell is subjected to rolling by means of a stretch reducer to have a prescribed outside diameter, yielding a seamless tube as a product.

In the past, there has been frequently used a 2-roll mandrel mill which has a plurality of roll stands, the roll stand each having a pair of opposite grooved rolls as a roll pass. In this 2-roll mandrel mill, the paired grooved rolls in the adjacent roll stand are shifted so as to be oriented by 90-degree with respect to drafting/reduction-rolling direction, relative to that of a reference roll stand.

Furthermore, in some mandrel mills, used is a 3-roll mandrel mill in which three grooved rolls are arranged as a roll pass in each roll stand, with the orientation of reduction-rolling direction being 120°, or a 4-roll mandrel mill in which four grooved rolls are arranged in each roll stand, with 90° orientation as the reduction-rolling direction.

In the production of seamless tubes by this mandrel mill, when the rolling conditions on the mandrel mill are not appropriate, fin flaws attributable to overfill and through-wall defects attributable to underfill may occur. Various proposals have hitherto been made in order to prevent these fin flaws and through-wall defects.

For example, Patent Literature 1 proposes a mandrel mill which increases the elongation ratio of tube (in other words, increases the manufacturing efficiency of seamless tubes) and can prevent the occurrence of through-wall defects attributable to underfill and a method of producing seamless tubes using this mandrel mill According to this proposed method, it is claimed that by using a 2-roll mandrel mill in which the roll diameter ratio (groove-bottom roll diameter divided by section diameter of elongation-rolled shell) of the first roll stand and the second roll stand is set at not less than 4.6 and a 3-roll mandrel mill in which the roll diameter ratio is set at not less than 2.8, it is possible to increase the manufacturing efficiency of seamless tubes without causing rolling defective.

Patent Literature 2 proposes a method of rolling seamless tubes which can prevent the occurrence of through-wall defects that pose a problem in the rolling of thin-walled tubes on a mandrel mill. According to this method, it is claimed that by setting the ratio of DF:roll diameter DF of groove bottom of rolling mill roll to RI:radius of curvature of groove bottom of rolling mill roll in at least one stand (preferably #2 stand, more preferably all stands) (hereinafter also referred to merely as the "ratio of RI/DF") at not less than 0.275, it is possible to produce thin-walled tubes by preventing the occurrence of through-wall defects.

Patent Literature 3 proposes a mandrel mill rolling method which can effectively prevent both overfill and underfill. This is a method which specifies the outside diameter of the shell and the ratio of groove caliber circumference length to finishing circumference length in the first stand and second stand in prescribed ranges for shells made of various steel grades such as ordinary carbon steel and alloy steel and having various wall thicknesses. According to this method, it is claimed that even by using the combination of rolling rolls made of solely one kind of groove caliber, it is possible to effectively prevent the occurrence of fin flaws attributable to overfill and hard-stripping (mandrel withdrawing) attributable to underfill as well as the occurrence of flaws attributable to hard-stripping.

In the methods of producing seamless tubes described in Patent Literatures 1 to 3, the occurrence of flaws and defects attributable to underfill and overfill is prevented by adjusting the roll diameter ratio, the ratio of RI: radius of curvature of relevant roll groove caliber to DF: groove-bottom roll diameter (i.e., RI/DF) or the ratio of circumference length of roll groove caliber to finishing circumference length.

However, because in multi-roll mandrel mills (3-roll or 4-roll mandrel mills) the profile of roll pass is subjected to geometric restrictions, the prevention of underfill and overfill with the above-described adjustment of the roll diameter ratio, RI/DF or the ratio of circumference length of groove caliber to finishing circumference length may be limited.

In addition, in designing the roll diameter ratio, it is necessary to control the roll diameter ratio in a given range in order to prevent the occurrence of flaws and defects attributable to underfill and overfill. However, when an appropriate roll diameter ratio is to be applied for controlling, this may be restricted by the structure of a roll housing.

FIGS. 1A and 1B are diagrams to explain an example of the case where designing the roll diameter ratio in a 3-roll mandrel mill is restricted. FIG. 1A schematically shows the arrangement of grooved rolls in an ordinary roll stand, and FIG. 1B schematically shows the side surface of a roll chock portion.

As shown in FIG. 1A, each roll stand is provided with three grooved rolls to constitute a roll pass 6, the roll each comprising a grooved roll body 1, a roll shaft 2 and a roll chock portion 3 that are integrated. The orientation of elongation rolling direction of each of the grooved roll bodies 1 is 120° apart. As shown in FIG. 1B, the roll chock portion 3 is composed of a bearing 4 and a bearing box 5.

In the roll stands of the 3-roll mandrel mill illustrated in FIG. 1, in particular, in the case where the elongation rolling of small-diameter tubes is performed, if the grooved roll diameter (the diameter of the grooved roll body) is designed to be small, an ordinary design of a roll housing encounters the interference of bearing boxes of the roll chock portions 3 with each other. For this reason, it is impossible to dispose the roll bodies 1 in a closer relation to each other, resulting in the occurrence of fin flaws.

In a multi-roll mandrel mill, the more the number of rolls, the more fin flaws are liable to occur. It seems that this is because the more the number of rolls, the narrower the high surface pressure region in the outer surface of the shell during rolling becomes in a width-wise (circumferential) direction, compared to that in the rolling direction, with the result that the metal flow in the rolling direction is constrained to facilitate the flow to occur in a width-wise (circumferential) direction.

In the case where a small-diameter tube is made on a multi-roll mandrel mill having a number of rolls, the fin flaw due to overfill becomes large. In particular, when the same reduction-rolling amount/draft as the case of a large-diameter tube is adopted, the reduction rate of outside diameter increases, facilitating the occurrence of fin flaws.

In a multi-roll mandrel mill which has 3 rolls, a gap adjustment between the arranged three grooved rolls is limited due to the interference of the roll chock portions. For this reason, the challenge is to control the roll diameter ratio in an appropriate range by eliminating the mutual interference between the roll chock portions so as to enable the underfill and overfill to be efficiently prevented.

In general, a multi-roll mandrel mill is effective in preventing defectives as through-wall flaws in tube, and in reducing wall thickness eccentricity, and the like. This effect is especially remarkable in thin-wall alloy steel tubes, and can increase productivity because a high elongation ratio can be ensured. For this reason, while a 2-roll mandrel mill is frequently used, a multi-roll mandrel mill which has more than 2 rolls, such as 3 or 4 rolls, is also used in some cases.

However, a multi-roll mandrel mill has the problem that designing the roll diameter ratio required for preventing underfill and overfill is limited. For this reason, the advantage of a multi-roll mandrel mill is not necessarily sufficiently exploited.

CITATION LIST

Patent Literature

Patent Literature 1: Japanese Patent Application Publication No. 2008-296250

Patent Literature 2: Japanese Patent Application Publication No. 2002-35810

Patent Literature 3: Japanese Patent Application Publication No. 2006-272340

SUMMARY OF INVENTION

Technical Problem

An object of the present invention is to provide a multi-roll mandrel mill which is free of the limitation in designing the allocation of circumference working that is necessary for preventing underfill and overfill attributable to the interference of the roll chock portions, in the production of seamless tubes using a multi-roll mandrel mill.

The other object of the present invention is to provide a method of producing a seamless tube using the multi-roll mandrel mill of the present invention.

Solution to Problem

FIG. 2 is a diagram to explain a nominal diameter of roll in a mandrel mill. In the elongation rolling on a conventional mandrel mill, even in the case of different outside diameters in tube-making, the nominal roll diameter of grooved rolls is almost the same. Therefore, the roll diameter ratio changes significantly depending on the setup of tube-making. If this roll diameter ratio changes, also the amount of fin changes significantly.

FIG. 3 is a diagram to explain the configuration and roll diameter ratio of a roll stand in a 3-roll mandrel mill. As shown in FIG. 3, in a 3-roll mandrel mill, for each roll stand, three grooved roll bodies 1 are arranged in such a manner that groove bottoms B are disposed in an opposite relation each other and the rolling surfaces thereof constitute a roll pass 6. And a shell 8 with a mandrel bar 7 being inserted therein is put in the roll pass 6 and is subjected to reduction-rolling by the grooved roll bodies 1 and the mandrel bar 7.

When the roll diameter in the groove bottom B of the grooved roll body 1 arranged in a roll stand (groove-bottom roll diameter) is denoted by Dr and the section diameter of the shell subjected to elongation-rolling by use of the grooved rolls is denoted by Dp, the roll diameter ratio is defined as Dr/Dp. At this time, the section diameter Dp of the shell is determined by the distance from a portion corresponding to the roll groove bottom B to an axial centerline O of the shell 8 as being a radius Dp/2.

Usually, the design of the allocation of circumference working is carried out while taking measures necessary for preventing underfill and overfill. As concrete measures for this purpose, for example, as described in Patent Literatures 1 to 3 above, the roll diameter ratio, the ratio RI/DF, or the ratio of circumference length of groove caliber to finishing circumference length are adjusted and controlled. One of these control indices is the roll diameter ratio.

According to the tube-making setup, the roll diameter ratio decreases when a large-diameter tube is made, and the underfill is apt to occur. On the other hand, when a small-diameter tube is made, the roll diameter ratio increases and the fin due to overfill become large. And with the number of rolls of a mandrel mill increasing, the fin tends to become large.

In particular, in the tube-making setup of small-diameter tubes, if the same amount of reduction in wall-thickness as in the case of large-diameter tubes is adopted, the reduction rate of outside diameter increases and hence the amount of finning increases.

Therefore, if the roll diameter of a grooved roll body is designed to be small in the tube-making setup of small-diameter tubes, as shown in FIG. 1A above, the bearing boxes of roll chock portions interfere with each other in the conventional design of a roll housing.

The present inventor investigated various measures to eliminate the interference of roll chock portions and to widen the range in which an adjustment of the gap between grooved rolls can be made even in the tube-making setup of small-diameter tubes, and as a result, the inventor paid attention to the measures (a) and (b) below.

(a) With respect to a roll chock portion, bearings which constitute this chock portion are internally contained in a grooved roll body, thereby making a bearing box unnecessary (in consideration of the feature of this method, this method is hereinafter referred to as "compacting of roll chock portions").

(b) In addition to the grooved roll body, at least one of the roll shaft and the roll chock portion is replaced for every tube-making setup (this process is hereinafter also referred to as "optimizing the design of the roll chock portion etc. for every setup").

The present invention was completed by paying attention to the above-described concrete measures, and the summary of the present invention resides in the multi-roll mandrel mills (1) to (3) below and a method of producing seamless tubes (4).

(1) A multi-roll mandrel mill including a plurality of grooved roll bodies as a roll pass which performs the elongation rolling of a shell, comprising a plurality of roll stands each having backup rolls for driving the grooved roll bodies, wherein bearings are internally contained in the above-described grooved roll body.

(2) A multi-roll mandrel mill including a plurality of grooved roll bodies as a roll pass which performs the elongation rolling of a shell, comprising a plurality of roll stands each having roll shafts and roll chock portions for driving the grooved roll bodies, wherein according to a tube-making setup of the mandrel mill, at least one of either or both of the roll shafts and the roll chock portions is replaced with a part(s) having a different shape(s), in addition to the grooved roll bodies.

(3) The multi-roll mandrel mill according to (1) or (2) above, wherein the multi-roll mandrel mill is a 3-roll mandrel mill.

(4) A method of producing seamless tubes which includes the step of elongation rolling of a shell by a multi-roll mandrel mill according to any of (1) to (3) above.

Advantageous Effects of Invention

A multi-roll mandrel mill of the present invention does not have bearing boxes which constitute roll chock portions or even when the multi-roll mandrel mill has bearing boxes, the bearing boxes do not interfere with each other, for example, being free of the limitation in designing the roll diameter ratio. Therefore, in the production of seamless tubes, it is possible to effectively prevent underfill and overfill. The multi-roll mandrel mill of the present invention is particularly advantageous for elongation rolling of small-diameter tubes.

Under a method of producing seamless tubes of the present invention, it is possible to produce seamless tubes free of through-wall defects attributable to underfill and fin flaws attributable to overfill.

BRIEF DESCRIPTION OF DRAWINGS

FIG. 1A schematically shows the arrangement of grooved rolls in an ordinary roll stand, and FIG. 1B schematically shows the side surface of a roll chock portion.

FIG. 4A is a perspective view of a grooved roll body in which bearings are internally contained, and FIG. 4B is a front view of the same.

FIG. 6A shows a conventional example, FIG. 6B shows an example of the present invention, and FIG. 6C is a diagram showing reserved parts to be used in interchanges in FIG. 6B.

DESCRIPTION OF EMBODIMENTS

While the configuration of the roll stand of a conventional mandrel mill is such that the same roll shafts and roll chock portions are used without regards to the tube-making setup, in the multi-roll mandrel mill of the present invention, there is adopted a configuration which permits the adjustment of a gap between the grooved rolls without limitation, eliminates the mutual interference of the roll chock portions and enables the roll diameter ratio to be controlled in an appropriate range.

In the following, the configuration adopted in the present invention will be described by being classified into "compacting of roll chock portions" and "optimizing the design of roll chock portions etc. for every setup" and "a method of producing seamless tubes" using the configuration as above will also be described.

[Compacting of Roll Chock Portions]

The multi-roll mandrel mill of the present invention is a mandrel mill including a plurality of grooved roll bodies as a roll pass which performs the elongation rolling of a shell, and a plurality of roll stands each having backup rolls for driving the grooved roll bodies, wherein bearings are internally contained in the above-described grooved roll body.

Figure 4A:
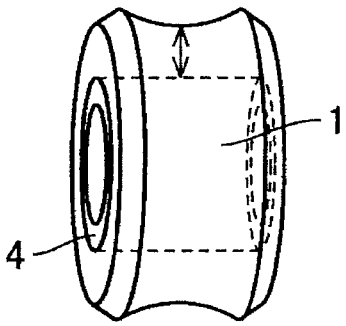
FIGS. 4A and 4B are diagrams to explain an embodiment of "compacting of roll chock portions" adopted in the multi-roll mandrel mill of the present invention.
Figure 4B:
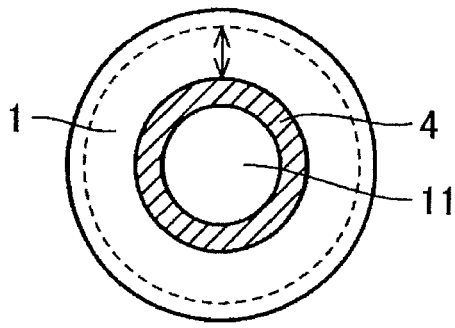

Specifically, as shown in FIGS. 4A and 4B of an embodiment described later, for a roll chock portion, there is adopted a configuration in which in order to widen the range of adjustment of a gap between grooved rolls, bearings constituting the roll chock portion is internally contained in the grooved roll body, thereby making a bearing box unnecessary.

In a conventional roll stand, a bearing box is attached outside the grooved roll body. However, in the multi-roll mandrel mill of the present invention, the bearing box becomes unnecessary and hence is removed.

As a result, the whole grooved roll is made compact and, therefore, even in the case where the grooved roll diameter (i.e., the diameter of the roll body) is designed to be small so as to be able to suitable for the elongation rolling of small-diameter tubes, the interference of the roll chock portions does not pose a problem any more. And the adjustment of a gap among three grooved rolls, which poses a problem in a 3-roll mandrel mill, is not limited and the gap adjustment becomes possible in a wider range.

Figure 5:
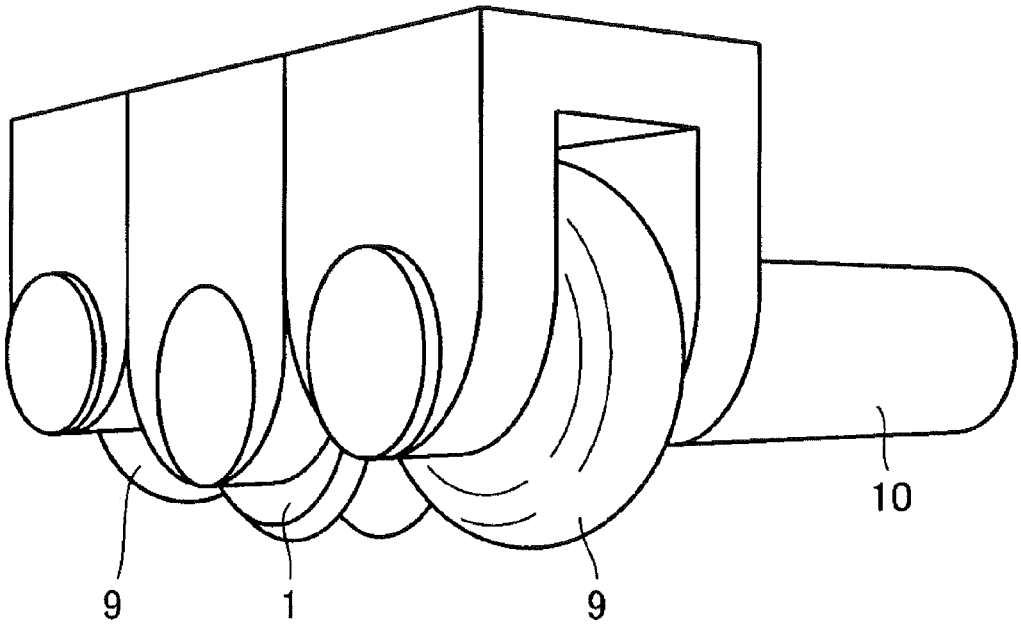
FIG. 5 is a perspective view showing the configuration of backup rolls for driving the grooved roll body (work roll) in which bearings are internally contained.

In this case, for example, as shown in FIG. 5 of an embodiment described later, bearings are internally contained in the grooved roll body and, therefore, it is necessary to adopt a configuration in which the grooved roll body (work roll) is driven by backup rolls.

Moreover, the strength required for the roll shaft and bearings is the same as in a conventional roll stand in which the roll chock portions are attached outside the roll body, yet the bearings are internally contained in the grooved roll body, so that under some rolling conditions, the strength of the roll groove portion may become insufficient.

Therefore, in carrying out the compacting of the roll chock portions in accordance with the present invention, in the design of the grooved roll body which involves containing the bearings in the interior, it is necessary to give due consideration to the relevant strength.

In which roll stand the means of "compacting of the roll chock portions" is fitted is not particularly limited. In consideration of the design of the roll diameter ratio, the roll stand in which this means is fitted may be part of the roll stand constituting the multi-roll mandrel mill or may be all of the stands in some cases.

[Optimizing the Design of Roll Chock Portions Etc. For Every Setup]

The multi-roll mandrel mill of the present invention is a multi-roll mandrel mill including a plurality of grooved roll bodies as a roll pass which performs the elongation rolling of a shell and a plurality of roll stands each having roll shafts and roll chock portions for driving the grooved roll bodies, wherein according to a tube-making setup, at least one of either or both of the roll shafts and the roll chock portions is replaced with a part(s) having a different shape(s) in addition to the grooved roll bodies.

"A tube-making setup" refers to performing, for example, preparations and operations for tube-making in consideration of changes in tube diameter (large-diameter tube, small-diameter tube and the like) and material grade (for example, plain carbon steel, high-alloy steel) during tube-making.

If the same roll shaft is used in making tubes having different outside diameters, the roll diameter ratio is too small or too large, with the result that it is impossible to prevent underfill or overfill. Further, if the same roll shaft is used regardless of the tube-making setup, undue situations may occur in the design of the strength of the roll shaft and bearings, the allocation of circumference working and the like.

Therefore, in the multi-roll mandrel mill of the present invention, at least one of either or both of the roll shafts and the roll chock portions is replaced as and when required in addition to the grooved roll bodies. In this case, as shown in FIG. 6B and FIG. 6C described later, it is possible to adopt reasonable processes as and when required; for example, the replacement of all of the grooved roll bodies, roll shafts and roll chock portions.

In adopting these processes, the roll body, the roll shafts and the roll chock portions are reserved as parts in advance, whereby it is possible to replace a relevant part(s) according to the condition of the tube-making setup, which is preferable.

Figure 1A:
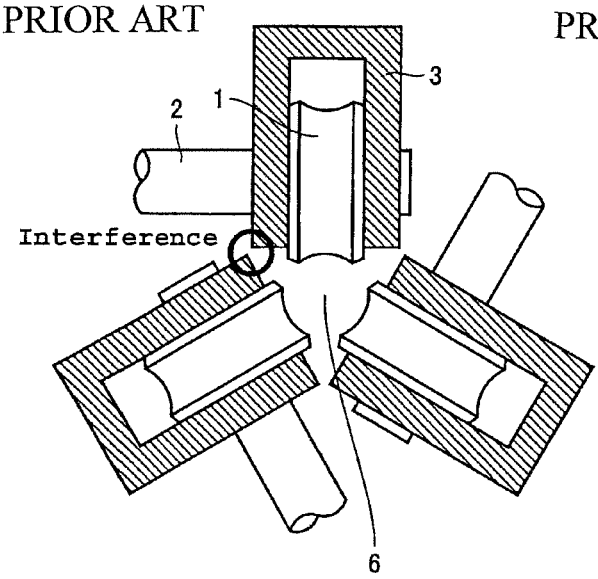
FIG. 1A PRIOR ART
FIGS. 1A and 1B are diagrams to explain an example of the case where designing the roll diameter ratio of a shell in a 3-roll mandrel mill is restricted.
Figure 1B:
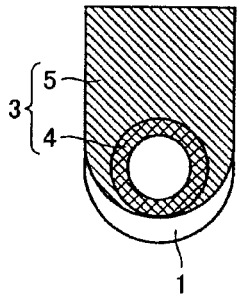
FIG. 1B PRIOR ART
Figure 2:
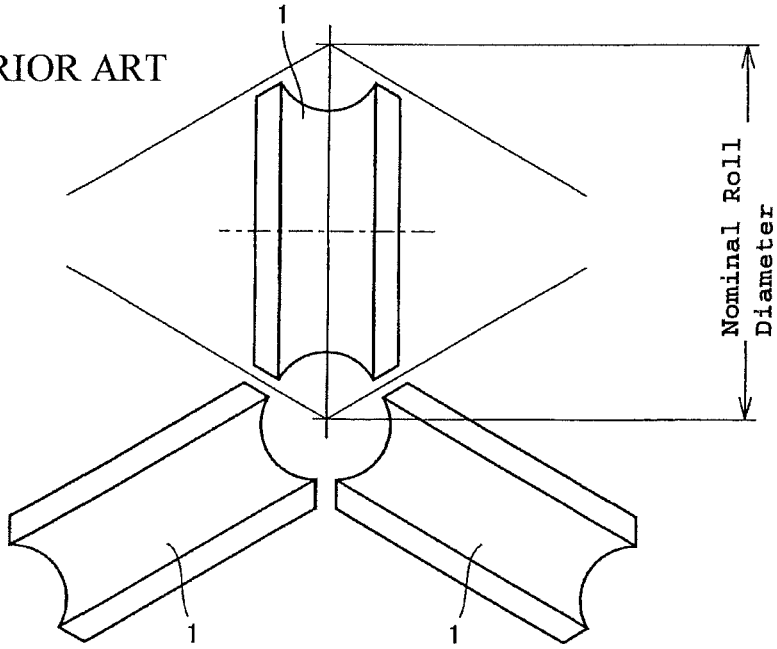
FIG. 2 PRIOR ART
FIG. 2 is a diagram to explain a nominal diameter of roll in a mandrel mill
Figure 3:
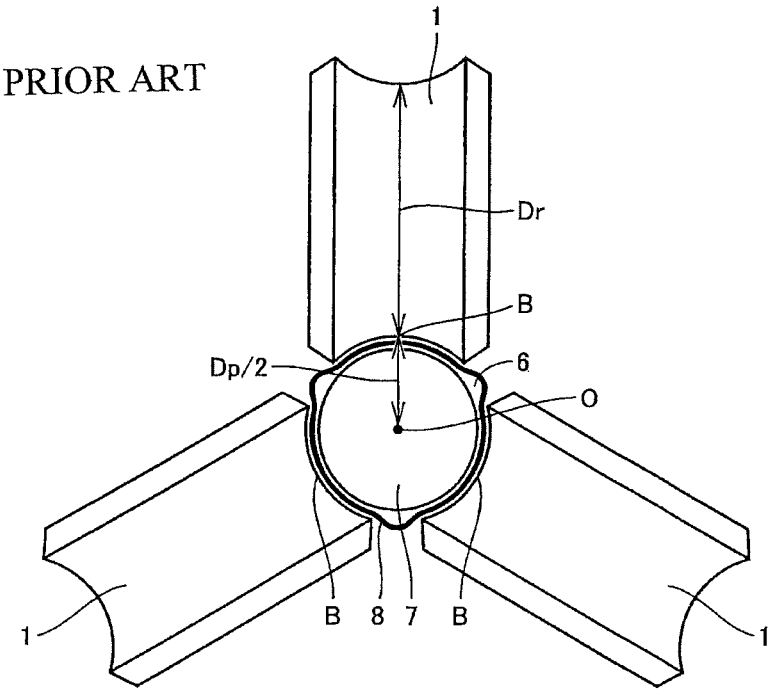
FIG. 3 PRIOR ART
FIG. 3 is a diagram to explain the configuration and roll diameter ratio of a roll stand in a 3-roll mandrel mill.

If consideration is given to the shape of the roll chock portion as a part so that the above-described mutual interference of the bearing boxes (see FIG. 1) does not occur, even in the elongation rolling for small-diameter tubes, it is possible to carry out the design of the allocation of circumference working necessary for preventing underfill or overfill.

In which roll stand the means of "optimizing the design of roll chock portions etc. for every setup" is fitted is not particularly limited. In consideration of the design of the allocation of circumference working, the roll stand in which this means is fitted may be part of each of the roll stands constituting the multi-roll mandrel mill or may be all of the stands in some cases.

In the multi-roll mandrel mill of the present invention, a desirable embodiment is the case where the multi-roll mandrel mill is a 3-roll mandrel mill. The above-described advantages (i.e., prevention of defectives such as through-wall flaws in tube, reduction of wall thickness eccentricity, ensuring high elongation ratio and the like) can be sufficiently exhibited in the above-described multi-roll mandrel mill by providing three rolls for the grooved rolls.

Furthermore, in the 3-roll mandrel mill of the present invention, the restraints in the roll diameter ratio can be eliminated by "compacting of roll chock portions" and "optimizing the design of roll chock portions etc. for every setup," which are adopted in the present invention.

Compared to a 4-roll mandrel mill, a 3-roll mandrel mill is simple in construction and a smaller number of rolls are used. Therefore, maintenance and control are relatively easy and hence this is a desirable embodiment.

[Method of Producing Seamless Tubes]

The method of producing seamless tubes of the present invention includes the step of perform elongation-rolling of a shell by the above-described multi-roll mandrel mill.

The production process of seamless tubes by a mandrel mill line includes the step of performing substantial elongation-rolling of a shell and the subsequent step of adjusting the wall thickness of the shell to a desired target value. In the method of producing seamless tubes of the present invention, the multi-roll mandrel mill of the present invention is used in the step of elongation rolling that is carried out upstream.

As a result, the occurrence of underfill or overfill during elongation rolling is effectively prevented and it is possible to produce seamless tubes free of any of through-wall defects attributable to underfill and fin flaws attributable to overfill. The method of producing seamless tubes of the preset invention is particularly effective in performing the elongation rolling for small-diameter tubes.

EXAMPLES

Embodiments of the present invention will be described with reference to the drawings.

[Embodiment of Compacting of Roll Chock Portions]

FIGS. 4A and 4B are diagrams to explain an embodiment of "compacting of roll chock portions" adopted in the multi-roll mandrel mill of the present invention. FIG. 4A is a perspective view of a grooved roll body in which bearings are internally contained, and FIG. 4B is a front view of the same. As shown in FIGS. 4A and 4B, bearings 4 are arranged in a part adjacently surrounding an interior portion 11 of a grooved roll body 1 where the roll shaft is inserted. As a result, a conventional bearing box which houses the bearings becomes unnecessary and the roll chock portion is made markedly compact, with the result that the problem of the interference of the roll chock portions is solved.

FIG. 5 is a perspective view showing the configuration of backup rolls for driving the grooved roll body (work roll) in which bearings are internally contained. Because the bearings are contained in the roll, backup rolls 9 are disposed on opposite sides of the grooved roll body 1 so as to sandwiching it to thereby drive it. The backup rolls 9 are integrally connected to a driving shaft 10.

At this time, the backup rolls 9 are positioned as being sufficiently retracted from the grooved roll body 1, so as to facilitate adjustment of a gap between grooved rolls.

The arrows shown in FIGS. 4A and 4B above indicate a remaining thickness in the roll groove portion of the roll body. Compared to the conventional thickness, this thickness decreases by an amount corresponding to the thickness of the bearings when the bearings are internally contained in the roll body. Therefore, as described earlier, it is necessary to give due consideration to the strength of the grooved roll body 1.

[Embodiment of Optimizing the Design of Roll Chock Portions Etc. for Every Setup]

Figure 6A:
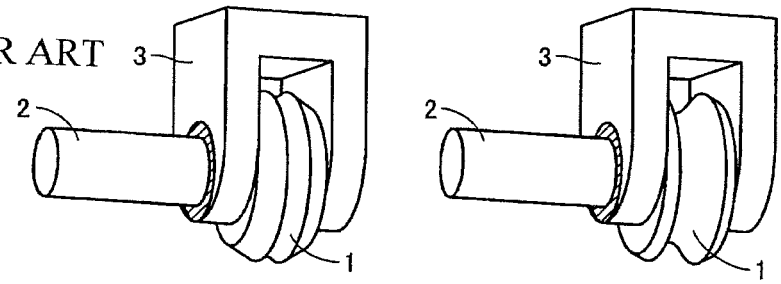
FIG. 6A PRIOR ART
FIGS. 6A to 6C are diagrams to explain an embodiment of "optimizing the design of roll chock portions etc. for every setup" adopted in the multi-roll mandrel mill of the present invention.
Figure 6B:
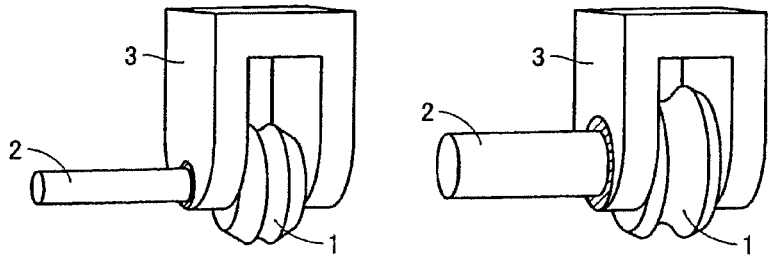
Figure 6C:
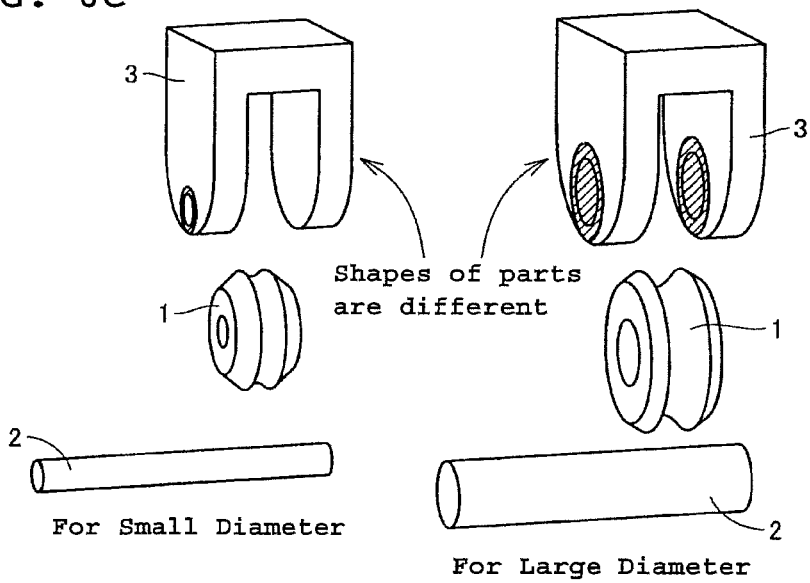

FIGS. 6A to 6C are diagrams to explain an embodiment of "optimizing the design of roll chock portions etc. for every setup" adopted in the multi-roll mandrel mill of the present invention. FIG. 6A shows a conventional example, which shows the case where without regards to the tube-making setup, a roll shaft 2 of the same diameter and a roll chock portions 3 of the same shape are used with the nominal roll diameter of the grooved roll body 1 being the same.

FIG. 6B shows an example of the present invention, which shows the case where the roll diameter of the grooved roll body 1 is changed in order to perform control to an appropriate roll diameter ratio according to a tube-making setup, and the roll shaft 2 and the roll chock portions 3 which are interchangeable so as to adapt to the roll diameter are used. FIG. 6C is a diagram showing reserved parts to be used in interchanges in FIG. 6B.

As shown in FIG. 6B, in order to carry out the design of the allocation of circumference working necessary for preventing underfill and overfill, a multi-roll mandrel mill which ensures the same roll diameter ratio in rolling a small-diameter tube and a large-diameter tube may be required. Specifically, in the tube-making setups for small-diameter tubes, it becomes necessary to use a grooved roll body 1 having a small roll diameter.

In this case, as shown in FIG. 6C, it is desirable that a roll stand in which all of the grooved roll body 1, the roll shaft 2 and the roll chock portions 3 are replaced be adopted in a mandrel mill. The expected purpose can be achieved by ensuring that the shapes of these parts might not arouse mutual interference between them, such as the case of the bearing boxes (see FIG. 1).

INDUSTRIAL APPLICABILITY

The multi-roll mandrel mill of the present invention and the method of producing seamless tubes using this multi-roll mandrel mill can be effectively used in the production of hot-worked seamless tubes (for example, seamless steel tubes).

REFERENCE SIGNS LIST

1: Roll body, 2: Roll shaft, 3: Roll chock portion, 4: Bearing, 5: Bearing box, 6: Roll pass, 7: Mandrel mill, 8: Shell, 9: Backup roll, 10: Driving shaft, 11: Portion where the roll shaft is inserted

What is claimed is:

1. A multi-roll mandrel mill comprising:

one set of grooved roll bodies forming a roll pass for performing elongation rolling of a shell of one diameter;

a plurality of roll stands, each roll stand having one set of roll shafts for supporting the grooved roll bodies and one set of roll chock portions for supporting the one set of roll shafts;

wherein the mandrel mill further comprises an additional set of roll shafts to replace the one set of roll shafts and an additional set of grooved roll bodies to replace the one set of grooved roll bodies, the additional set of roll shafts and the additional set of grooved roll bodies corresponding to a shell having a different diameter from the one diameter, and further wherein a diameter of the roll shaft of the additional set of roll shafts is different from a diameter of the roll shaft of the one set of roll shafts.

2. The multi-roll mandrel mill according to claim 1, further comprising an additional set of roll chock portions to replace the one set of roll chock portions, the additional set of roll chock portions being used in combination with the additional set of roll shafts.

3. The multi-roll mandrel mill according to claim 1, further comprising an additional set of roll chock portions to replace the one set of roll chock portions, the additional set of roll chock portions being used in combination with the additional set of roll shafts, and wherein:

a) for the one set of grooved roll bodies and the one set of rolls shafts for rolling of the shell of the one diameter, the roll shaft of the one set of roll shafts has a first diameter; and b) for the additional set of grooved roll bodies and the additional set of rolls shafts for rolling of the shell of the different diameter, the shell of the one diameter being smaller than the shell of the different diameter, the roll shaft of the additional set of roll shafts has a second diameter that is larger than the first diameter;

wherein a distance between a central axis of the roll shaft of the one set of roll shafts that are performing elongation rolling of the shell of the one diameter and an axial centerline of the shell that is rolled by the one set of roll shafts of the one diameter is smaller than a distance between a central axis of the roll shaft of the additional set of rolls shafts that is performing elongation rolling of the shell of the different diameter and an axial centerline of the shell that is rolled by the additional set of roll shafts of the different diameter.

4. A method of producing seamless tubes, comprising the step of:

elongation-rolling a shell by a multi-roll mandrel mill according to claim 1.

* * * * *